US006076518A

United States Patent [19]

Klouda et al.

[11] Patent Number: 6,076,518

[45] Date of Patent: Jun. 20, 2000

[54] STEAM GENERATOR

[75] Inventors: Jaroslav Klouda, Fuerstenfeldbruck, Germany; Maarten Joannes Botman, Utrecht, Netherlands

[73] Assignee: Rational GmbH, Landsberg a. Lech, Germany

[21] Appl. No.: 09/032,039

[22] Filed: Feb. 27, 1998

[30] Foreign Application Priority Data

Feb. 28, 1997 [DE] Germany ..... 197 08 229

[51] Int. Cl.[7] ..... F22B 7/12

[52] U.S. Cl. ..... 126/391; 122/367.1; 122/158

[58] Field of Search ..... 126/391, 360 R, 126/392, 366; 122/367.1, 367.2, 158, 166.1, 124, 184

[56] References Cited

U.S. PATENT DOCUMENTS 608,291 8/1898 Kemp ..... 126/360 R 4,178,880 12/1979 Östbo ..... 122/182.2

FOREIGN PATENT DOCUMENTS 295 00 595 U 4/1995 Germany .

2285739 7/1995 United Kingdom .

*Primary Examiner*—Ira S. Lazarus
*Assistant Examiner*—Sara Clarke
*Attorney, Agent, or Firm*—Hill & Simpson

[57] ABSTRACT

A steam generator has a steam boiler, a burner shaft for receiving hot exhaust gasses from a burner extending into the steam boiler, at least one heat exchanger section with one or more channels extending through the boiler for conducting exhaust gasses from the burner shaft through the heat exchanger to an exhaust system. The connection between the burner shaft and the channels of the heat exchanger is by an opening in the sidewall of the burner shaft, which is partially closed by a slidable insert that allows adjusting the size of the opening. The insert can be hollow and can have an opening spaced from the opening in the sidewall to allow bypassing some exhaust gasses to a point in the channels downstream from the opening in the sidewall.

17 Claims, 4 Drawing Sheets

STEAM GENERATOR

BACKGROUND OF THE INVENTION

The present invention is directed to a steam generator, particularly for employment in kitchen technology, which has a steam boiler, a burner shaft extending into the boiler and at least one heat exchanger section with one or more channels extending through the boiler for conducting exhaust gasses from the burner shaft through the boiler to an exhaust connected at one end of the channels so that the flow of exhaust gasses from the burner shaft through the channels to the exhaust transfers heat through the walls of the channel to a liquid within the boiler. The burner shaft is connected via a connecting section to the channels, which are arranged so that the flow direction of the gasses flowing in the channel or channels to the exhaust differs from the flow direction of the gasses in the burner shaft. The steam generator, as mentioned, is particularly used in a cooking apparatus in large-scale catering technology.

German Utility Model 295 00 595.5 discloses a steam generator having a construction wherein the burner shaft is connected with channels for the heat exchange via a simple transverse shaft having a constant cross-section that is fashioned in the steam boiler. This construction is complicated and does not lead to an optimum diversion of the exhaust gasses of the burner that are introduced into the burner shaft to the channels of the heat exchanger section.

SUMMARY OF THE INVENTION

The object of the present invention is to create a steam generator wherein the diversion of gas flow from the burner to the channels of the heat exchanger section is solved with a simple means in a way that enables an optimization of the flow conditions in the channel or channels of the heat exchanger section.

This object is achieved by a steam generator which comprises a steam boiler, a burner shaft extending into the steam boiler, at least one heat exchanger section with one or more channels extending through the boiler and being connected at one end to an exhaust and at another end to the burner shaft via a connecting section so that exhaust gasses are conducted from the burner shaft through the channels to the exhaust with the heat from the exhaust gasses being transferred through walls of the channels to the liquid in the boiler which contacts the walls. The connecting section is arranged so that the flow direction of the gasses from the burner to the exhaust in each of the channels differs from the flow direction in the burner shaft and the connecting section comprises a passage that is formed by an opening in the wall of the burner shaft, particularly in the sidewall of the burner shaft, and an insert, whereby the opening connects the burner shaft to one or more of the channels of the heat exchanger section and is partly closed by an insert.

It can thereby be particularly provided that the gas stream in the channels of the heat exchanger section is opposite the direction of the gas stream that is incident into the burner shaft. The burner shaft can thereby be connected to the burner at one end and can be closed at the other end, whereby, except for the passage or passages, the shaft is likewise closed on all sides. Advantageously, the burner shaft can be fashioned in the steam boiler so that the walls of the shaft are walls of the steam boiler at the same time and are cooled by a liquid in the steam boiler. Typically, the channel or channels of the heat exchanger section and the burner shaft extend parallel to each other so that the exhaust gasses are diverted by 180° in the connecting section, so that the exhaust gasses in the channels flow in a direction opposite to the flow in the burner shaft.

The invention can provide that the opening is fashioned in the sidewalls of the burner shaft and comprises a mouth or adjustable passage at the admission side of the exhaust gasses coming from the burner into the burner shaft and that the insert is connected to the walls of the burner shaft in the fashion of a spring channel connection. This enables an especially simple design, wherein the insert is plugged into the walls of the burner shaft in the fashion of a slide. The insert can preferably have either an A-shaped or H-shaped cross-section with one or more channels for receiving the edges of the opening. Given this design, it is possible to set the cross-section of the passage in a simple way, namely by displacing the slide, and to thereby influence the flow to the channels of the heat exchanger section.

The invention can further provide that the inside of the insert comprises a hollow space with an opening that receives gasses from the passage. It can thereby be provided that the hollow space comprises at least one additional opening, preferably a plurality of openings, that are connected to one or more channels at a location downstream from the passage, so that the part of the flow path in the channel or channels is bridged or bypassed. The insert thereby forms a flow bypass that allows hot exhaust gasses to be conducted to a region of the channels of the heat exchanger in which the exhaust gasses have already been cooled and in which only a slight heat exchange would otherwise occur.

The invention can also provide that the heat exchanger section comprises a distributor channel adjoining the passage downstream from which a plurality of side channels branch off. A deflection means for the deflection of exhaust gasses coming from the passage into the longitudinal direction of the side channels can thereby be provided and arranged between the admission and the side channels. The passage can be fashioned as a throttle, whereby the gas passing therethrough is relaxed at the side of the heat exchanger section after passing through.

It is also inventively provided that the steam generator comprises a plurality of preferably essentially identically fashioned heat exchanger sections, whose flow system for the exhaust gasses of the burner is respectively connected to the burner shaft via a passage in the wall of the burner shaft.

Particularly when the walls of the burner shaft are walls of the steam boiler at the same time, the invention also comprises an anti-overheating pipe in the burner shaft for the admission of the exhaust gasses of the burner into the burner shaft below the level of the liquid level in the steam boiler. The mouth of the anti-overheating pipe is thereby preferably located below the minimum liquid level that is permitted for the operation of the boiler. In particular, it can thereby be provided that the mouth of the anti-overheating pipe is located just above the level of the passage or passages that connect the burner shaft with the flow system of each heat exchanger section.

The invention can also provide that the transfer channel is fashioned between the walls of the burner shaft and the anti-overheating pipe, and that the insert comprises a second passage which connects one or more channels of the heat exchanger section to the transfer channel at a location of the channel downstream from the first passage, so that a part of the flow path from the first passage to the exhaust is bridged or bypasses a portion of the channel, whereby the first passage is formed outside of the transfer channel.

Inventively, the connection of the burner shaft to the flow system of the heat exchanger section is achieved in a simple and elegant way, wherein the flow condition in the passage can be influenced at the same time by the selection of a specific form of the insert, so that an optimum distribution of the exhaust gas stream onto the channels for the heat exchanger will occur. In particular, the cross-section of the passage between the burner shaft and the heat exchanger section can be set so that the parts of the gas stream that flow to the channels in the heat exchanger section at a greater distance from the burner shaft is increased and, thus, the gas stream is evened out onto the channels of the heat exchanger section. Since the insert can be manufactured independently of the steam boiler and the burner shaft, additional flow-conducting or flow-limiting measures can be realized in a simple way by a corresponding shaping of the insert.

Other advantages and features of the invention will be readily apparent from the following description of the preferred embodiments, the drawings and claims.

DESCRIPTION OF THE PREFERRED EMBODIMENTS

Figure 1:
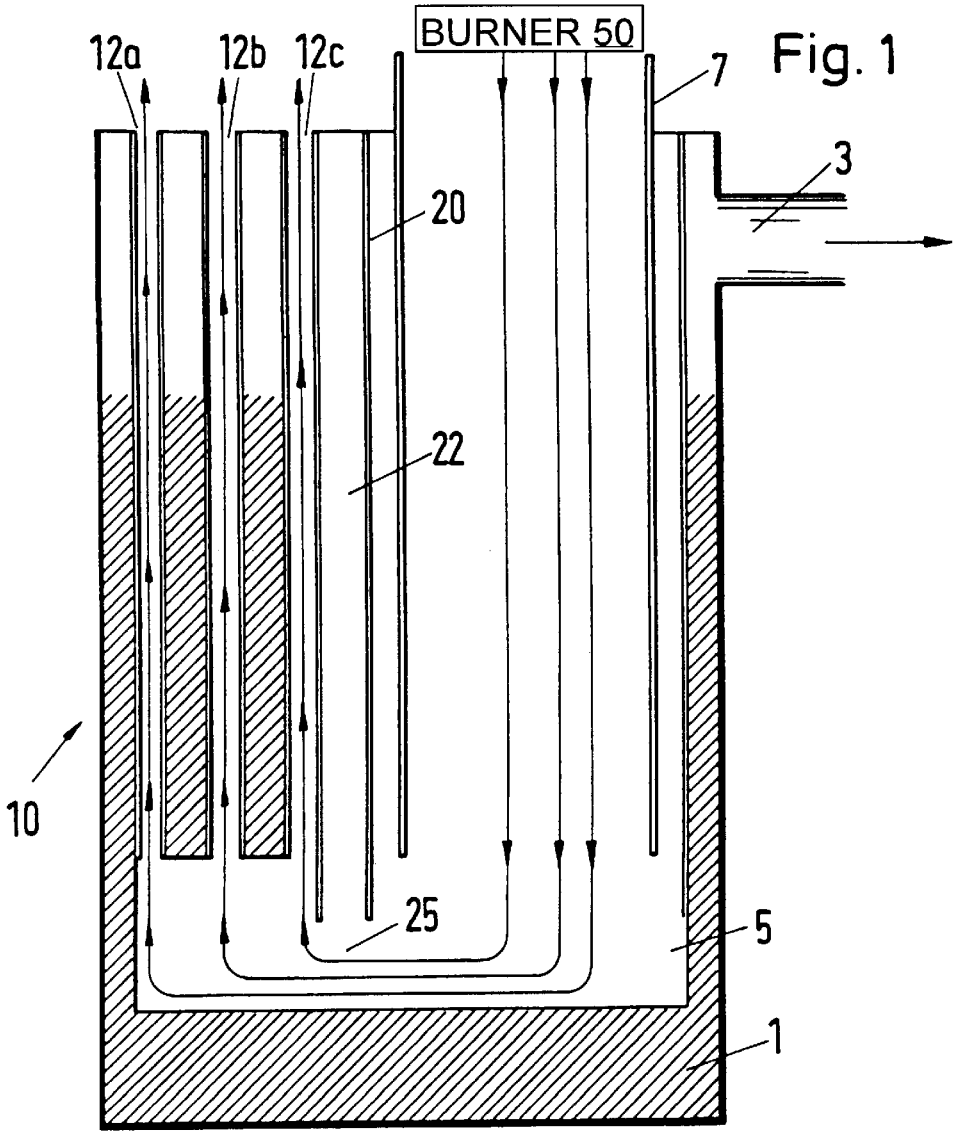
FIG. 1 is a longitudinal cross-sectional view of a first embodiment of the steam generator of the present invention.
Figure 2:
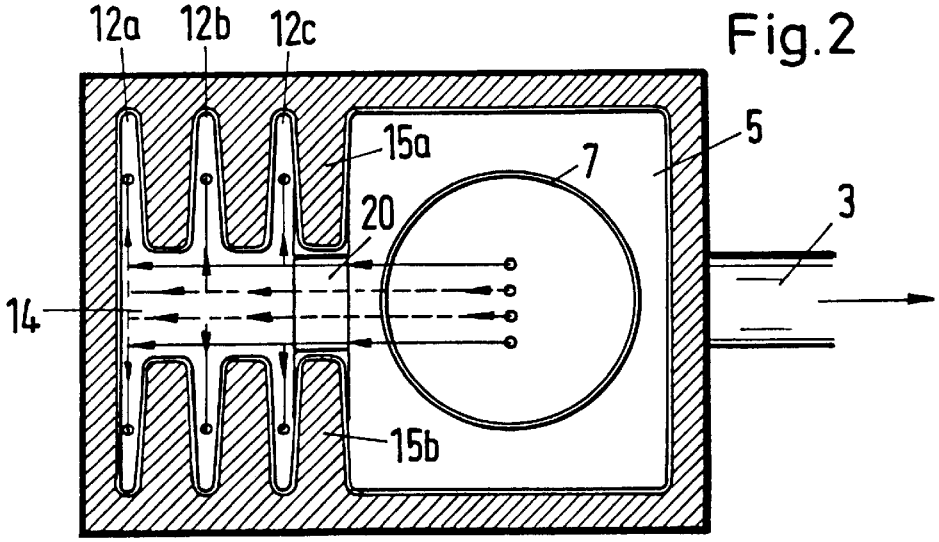
FIG. 2 is a plan view of the steam generator of FIG. 1.

The principles of the present invention are particularly useful when incorporated in a steam generator shown in FIGS. 1 and 2, which includes a water-filled steam boiler 1, with the level of the water being indicated by shaded lines and which has an outlet 3, through which steam can be removed. A burner shaft 5 extends into the boiler 1 and receives exhaust gasses from a gas burner 50 through an anti-overheating pipe 7, which extends into the shaft 5. The exhaust gasses are conducted to a heat exchanger section 10 that has a plurality of channels 12*a*, 12*b* and 12*c*, which branch off from a distributor or distribution channel 14 and extend through the boiler 1 to terminate in an exhaust, which is not shown. The walls of the channels 12*a*, 12*b* and 12*c*, as well as the channel 14, will transfer the heat from the exhaust gas to the water in the steam boiler 1. The distributor channel 14 also will discharge into the above-mentioned exhaust.

An upwardly open opening between the wall sections 15*a* and 15*b* of the burner shaft 5 is located between the burner shaft 5 and the distribution channel 14. An H-shaped insert 20 is introduced into this opening, whereby, respectively, two parallel flanges of the insert embrace the two wall sections 15*a* and 15*b* in the fashion of a channel so that the insert can be mounted by being plugged on the wall sections and shifted. Wall sections 15*a* and 15*b*, which are hollow and fill with liquid, form tongues which are received in the grooves, which are formed by the flanges of the H-shaped insert 20. The insert 20 serves as a throttle shaft or valve and comprises an upwardly closed hollow space 22. The insert 20 projects downward beyond the lower ends of the channels 12*a* through 12*c* and, together with the wall sections 15*a* and 15*b* as well as the floor of the opening between these wall sections, forms a passage or mouth 25 (FIG. 1), which provides a flow limitation for the gas stream coming from the burner shaft 5. As can be seen from FIG. 1, the distribution channel 14 extends under the side channels 12*a*–12*c* in the lower region so that a deflection section having a larger cross-section than that of the passage 25 is formed. By displacing the insert 20, the cross-section of the passage 25 that forms the transition from the burner shaft 5 to the heat exchanger section 10 can be set so that especially favorable flow conditions and optimum heat transfer are guaranteed. For operation, this cross-section is held constant by fixing the insert in the desired position on the wall sections 15*a* and 15*b*.

The combustion chamber of the gas burner preferably merges directly into the anti-overheating pipe 7, which, for example, is composed of steel. The anti-overheating pipe 7 conducts the exhaust gasses of the burner onto a level below the water level in the steam boiler 1 and, preferably, to approximately the height of the beginning of the channels 12*a*–12*c*, as shown in FIG. 1. What is thus avoided is that the hot exhaust gasses of the burner come into contact with an uncooled wall section of the burner shaft 5, which would be above the water level and cause overheating of this wall. Typically, the anti-overheating pipe is part of the combustion chamber of the burner.

The exhaust gasses of the burner emerging from the anti-overheating pipe 7 are deflected by 180° to the channels 12*a*–12*c* and 14 and enter into the heat exchanger section 10 via the passage 25 of the connecting section. Due to the smaller cross-section of the passage 25, the gas stream is provided with a strong momentum or momentum component transverse to the original flow direction, and this leads to providing the flow channel 12*a*, which is placed radially farther outward from the burner shaft 5, with an adequate portion of the gas stream. The exhaust gasses then flow in the channels 12*a*, 12*b* and 12*c* as well as 14 in a direction opposite to the flow in the burner shaft 5 to the exhaust and, thereby, output heat to the walls of the channels and, therefore, to the liquid in the steam boiler 1.

Figure 3:
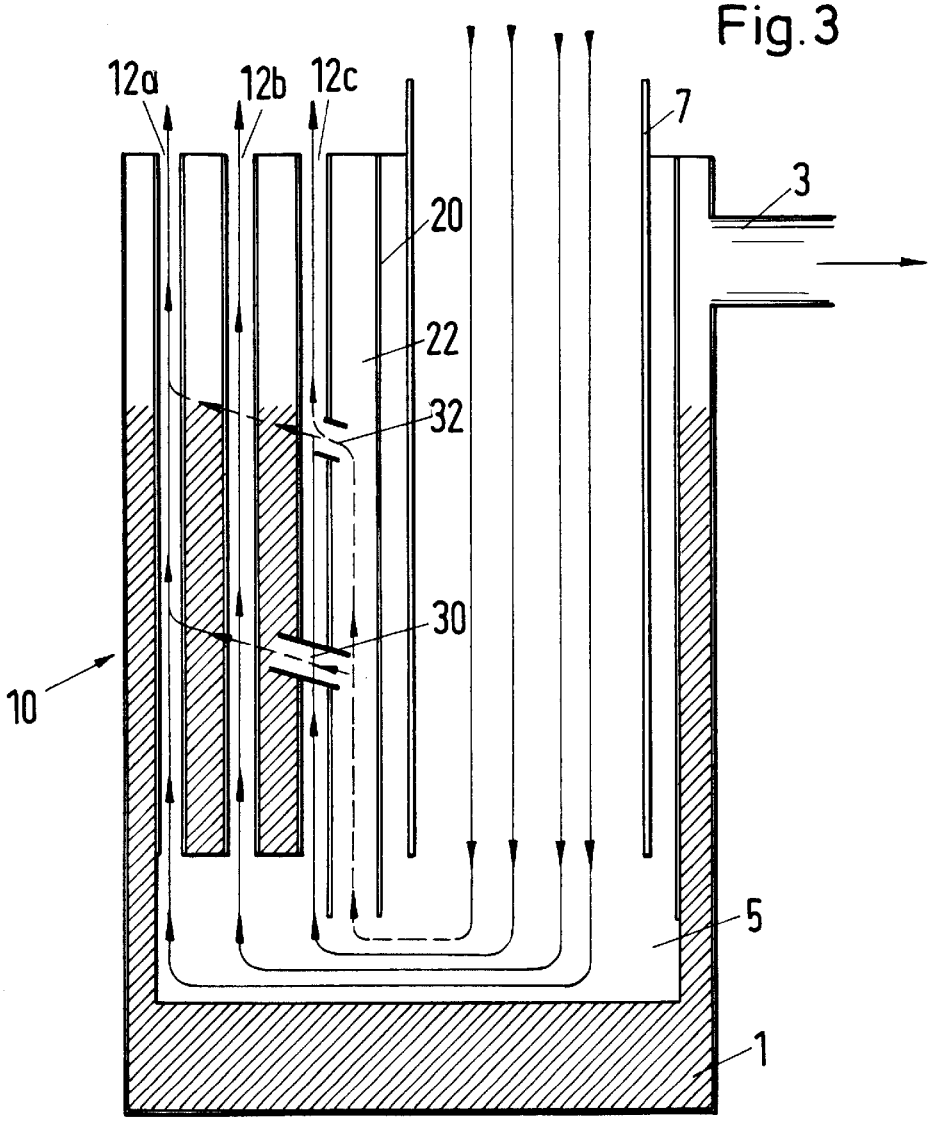
FIG. 3 is a longitudinal cross-sectional view of a second embodiment of the steam generator of the present invention.
Figure 4:
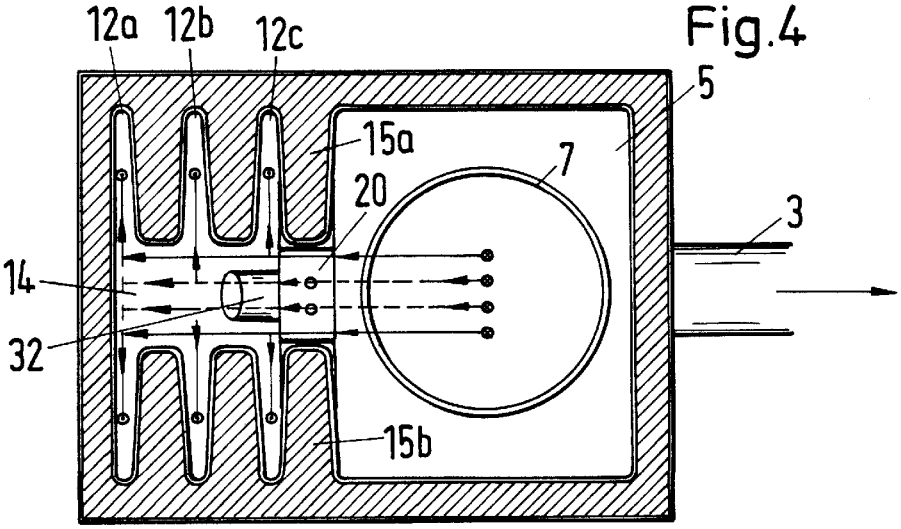
FIG. 4 is a plan view of the steam generator of FIG. 3.

In a second embodiment of the invention shown in FIGS. 3 and 4, the insert 20 comprises additional pipe sections 30 and 32 that connect the distributor channel 14 to the inner hollow space 22 of the insert 20. The interior of the insert 20 thus forms an uncooled bypass path for a part of the hot exhaust gasses that come from the burner shaft 5 and delivers these hot exhaust gasses to locations of the channels 12*a*–12*c* at which those exhaust gasses that have not taken the bypass path via the insert 20 have already cooled. This will even out the heat transfer in the axial direction. Since the hot exhaust gasses in the region of the passage 25 reside under a higher pressure than the already cooled gasses in the channels 12*a*–12*c* at the level of the pipe connections 30 and 32, a suction in the shaft 22 occurs in the region of the passage 25, and this will promote the bypass flow through the shaft.

Figure 5:
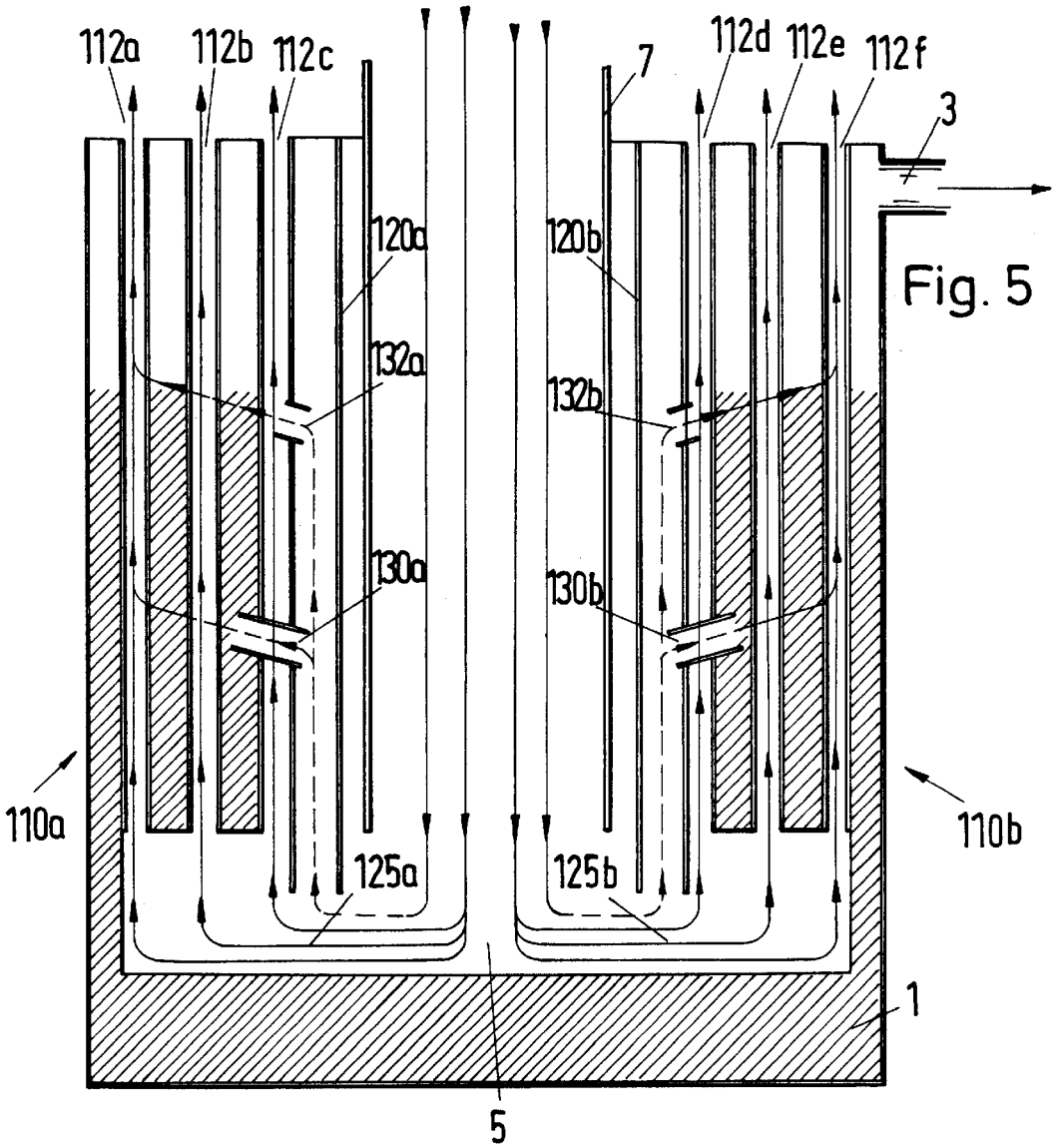
FIG. 5 is a longitudinal cross-sectional view of a third embodiment of the steam generator of the present invention.
Figure 6:
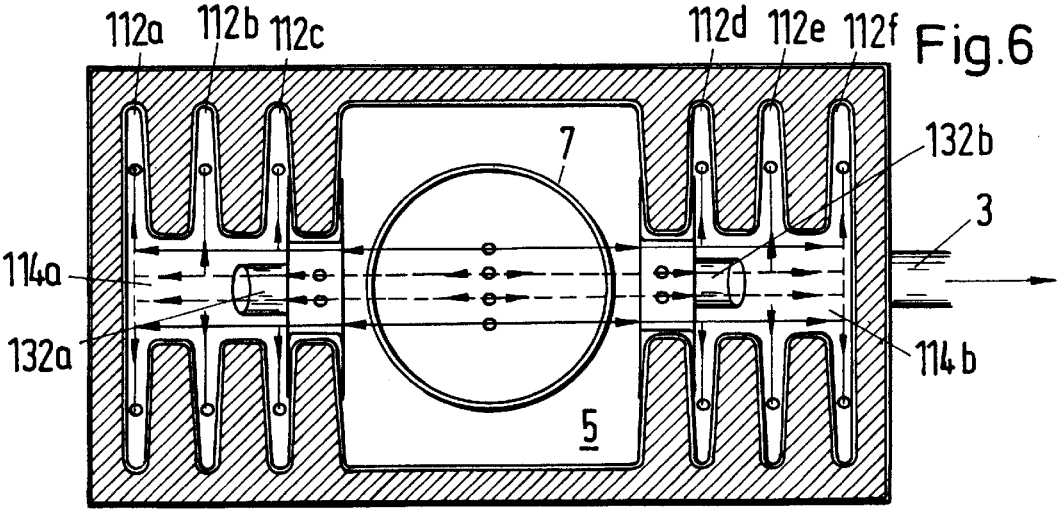
FIG. 6 is a plan view of the stem generator of FIG. 5.

A third embodiment of the invention is shown in FIGS. 5 and 6 and essentially corresponds to the second embodiment of FIGS. 3 and 4. Here, however, two symmetrically arranged, identically constructed heat exchanger sections 110*a* and 110*b* are provided, with the section 110*a* having heat exchanger channels 112*a*–112*c* with a distributor channel 114*a*, and with the section 110*b* having heat exchanger channels 112*e*–112*f* with a distributor channel 114*b*. Each of the heat exchanger sections has a hollow insert 120*a* or 120*b* allocated to it, which will limit the passage 125*a* or 125*b* in the region of the connecting section to the burner shaft 5. The hollow insert 120*a* has pipes 130*a* and 132*a*, while the insert 120*b* has pipes 130*b* and 132*b* with which a hot exhaust gas can be delivered at a location of the distributor shafts 114*a* and 114*b*, respectively, farther up. The design corresponds essentially to that of the second embodiment of FIGS. 3 and 4. Of course, even more heat exchanger sections than the two heat exchanger sections shown in FIGS. 5 and 6 can be provided, and these are capable of being arranged, for example, along an axis extending perpendicular to the connecting axis between the heat exchanger sections 110*a* and 110*b*. Other arrangements of heat exchanger sections are also possible, for example, annular or polygonal arrangements. Likewise, a plurality of heat exchangers according to FIG. 1 can be combined with one another or with heat exchangers according to FIG. 3.

Figure 7:
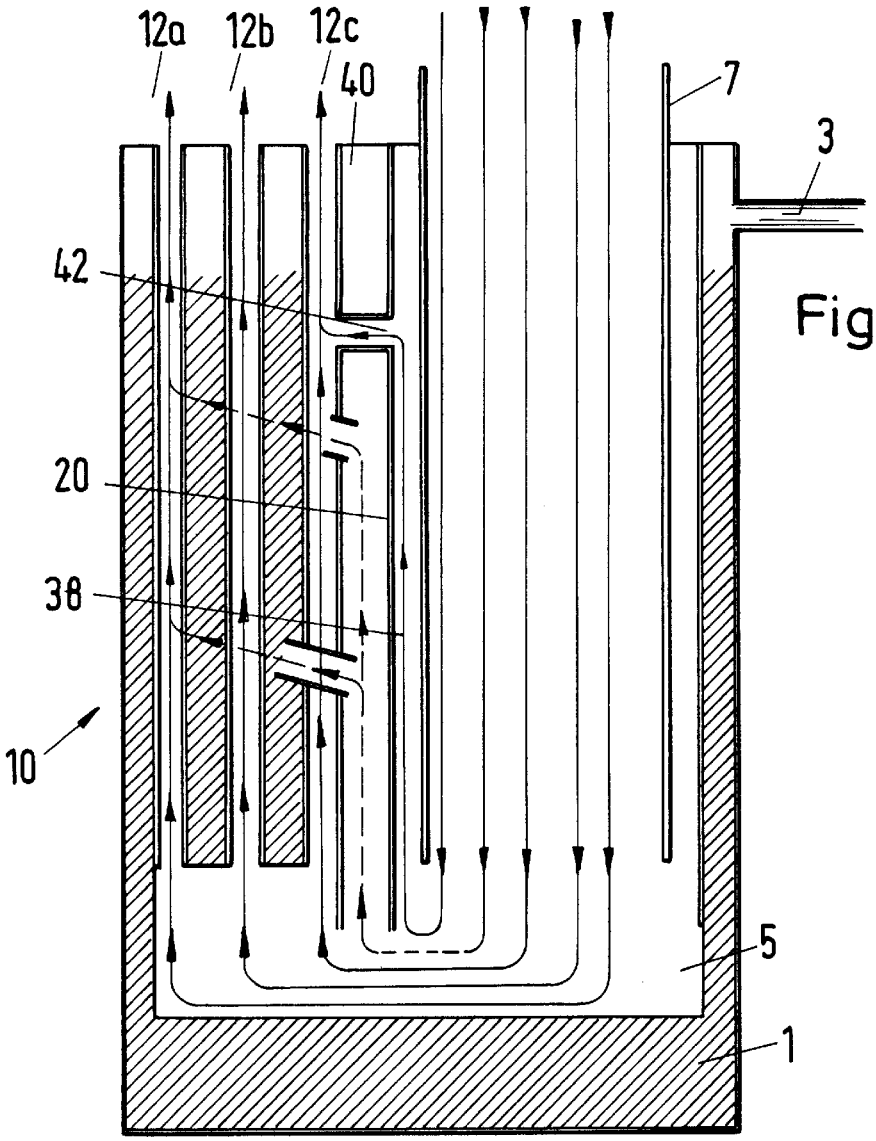
FIG. 7 is a longitudinal cross-sectional view of a fourth embodiment of the steam generator of the present invention.
Figure 8:
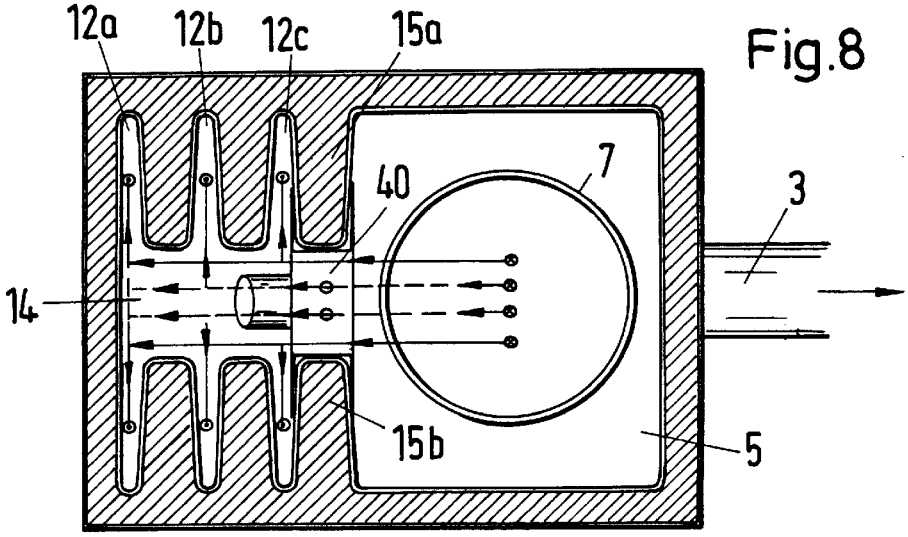
FIG. 8 is a plan view of the steam generator of FIG. 7.

A fourth embodiment of the invention is shown in FIGS. 7 and 8 an essentially comprises the second embodiment of FIGS. 3 and 4. However, the upper end of the burner shaft 5 surrounding the anti-overheating pipe 7 is upwardly closed, so that a further flow channel 38 is formed between the anti-overheating pipe 7 and the insert 20. The insert 20 does not extend up to the upper end of the burner shaft 5, but ends at a certain distance therefrom, whereby an upper end of the interior hollow space 22 is closed. An additional, downwardly closed insert 40 is arranged above the insert 20 between the wall sections 15*a* and 15*b*, so that a passage 42 remains free between the lower end of the insert 40 and the upper end of the insert 20. In a way similar to the pipes 30 and 32, this passage 42 serves for conducting hot exhaust gasses into an upper region of the distributor channel 14 or, respectively, the channels 12*a*–12*c*, in which exhaust gasses have already not taken the path via the channel 38 have already been cooled due to the heat exchange with the liquid in the steam boiler 1.

Although various minor modifications may be suggested by those versed in the art, it should be understood that we wish to embody within the scope of the patent granted hereon all such modifications as reasonably and properly come within the scope of our contribution to the art.

We claim:

1. A steam generator comprising:

a steam boiler, a burner shaft extending into the boiler for receiving hot exhaust gasses from a burner, and at least one heat exchanger section with at least one channel extending through the boiler for conducting exhaust gasses of the burner through the steam boiler so that heat in the exhaust gasses is transferred through walls of each channel to the liquid in the boiler, each channel at one end being connected to an exhaust and at the other end being connected to the burner shaft by a connecting section, each channel being arranged so that a flow direction of the gasses flowing in the channel is different from a flow direction in the burner shaft, the connecting section comprising a passage that is formed by an opening in a wall of the burner shaft and an insert, whereby the opening connects the burner shaft to each channel of the heat exchanger section and is partly closed by the insert.

2. A steam generator according to claim 1, wherein the opening in the sidewall comprises an adjustable passage at an admission side of the burner shaft for the exhaust gasses coming from the burner into the burner shaft and the insert is connected to the wall of the burner shaft with a tongue and groove connection.

3. A steam generator according to claim 1, wherein an inside of the insert comprises a hollow space with a first opening in communication with the passage.

4. A steam generator according to claim 3, wherein the hollow space comprises at least one additional opening that is connected to at least one of the channels of the heat exchanger section at a location downstream from the passage so that the part of the flow path in the channel is bypassed.

5. A steam generator according to claim 1, wherein the heat exchanger section comprises a plurality of side channels and a distributor channel extending downstream from the passage and being connected to the plurality of side channels.

6. A steam generator according to claim 5, wherein a deflecting means is arranged between the passage and the side channels for deflecting the exhaust gasses flowing through the passage into a longitudinal direction of the side channels.

7. A steam generator according to claim 1, which includes a plurality of heat exchanger sections, with each section having a flow system for exhaust gasses from a burner connected to the burner shaft via a passage in the wall of the burner shaft.

8. A steam generator according to claim 1, wherein an anti-overheating pipe extends into the burner shaft for an introduction of the exhaust gasses of the burner into the burner shaft below a level of liquid in the steam boiler.

9. A steam generator according to claim 8, wherein the mouth of the anti-overheating pipe is located just above a level of the passage that connects the heat exchanger section to the burner shaft.

10. A steam generator according to claim 8, wherein a transfer channel is fashioned between the walls of the burner shaft and the anti-overheating pipe and the insert forms a second passage for connecting at least one channel of the heat exchanger section to the transfer channel at a location downstream from the first-mentioned passage so that part of a flow path from the first-mentioned passage to the exhaust is bypassed by exhaust gasses flowing through the transfer channel.

11. A steam generator comprises:

a steam boiler, a burner shaft extending into the seam boiler for receiving hot exhaust gasses from a burner, and at least one heat exchanger section having a plurality of channels extending through the steam boiler for conducting exhaust gasses from the burner shaft through to an exhaust to cause heating of liquid contacting walls of the channels, said channels being connected to the burner shaft by a distributor channel connected to a passage formed in an opening in a wall of the burner shaft and limited by an insert which partially closes said opening, said channels of the heat exchanger sections extending parallel to the burner shaft so that a flow in the channels is in a direction opposite a direction of a flow in the burner shaft.

12. A steam generator according to claim 11, wherein the insert is slidable in the opening to change the size of said opening.

13. A steam generator according to claim 11, wherein the insert has a hollow space with an opening in communication with the passage and includes additional openings at a location downstream from the passage for discharging a flow from the hollow space into at least one channel downstream from the connection to said passage.

14. A steam generator according to claim 11, which includes an anti-overheating pipe extending from the burner into the burner shaft and terminating at a point below the level of the liquid in the steam boiler.

15. A steam generator according to claim 14, wherein the insert has a hollow space in communication with the passage and has additional openings at a location downstream from the passage for discharging a flow in the hollow space into at least one channel downstream from the connection to the passage.

16. A steam generator according to claim 15, wherein a transfer channel is fashioned between the walls of the burner shaft and the anti-overheating pipe and the insert forms a second passage for connecting the channels of the heat exchanger section to the transfer channel at a location downstream from the first-mentioned passage so that part of the flow path from the first-mentioned passage to the exhaust is bypassed by exhaust gasses flowing through the transfer channel.

17. A steam generator according to claim 15, which includes a second heat exchanger section having a structure of the at least one heat exchanger section.

* * * * *